US005340284A

United States Patent [19]

Nicol

[11] Patent Number: 5,340,284

[45] Date of Patent: Aug. 23, 1994

[54] TWO STAGE FUEL PUMP WITH PRESSURE PASSAGE IN THE FIRST STAGE ROTOR

[75] Inventor: Stuart W. Nicol, London, England

[73] Assignee: Lucas Industries Public Limited Company, West Midlands, England

[21] Appl. No.: 29,320

[22] Filed: Mar. 10, 1993

[30] Foreign Application Priority Data

Mar. 20, 1992 [GB] United Kingdom ..... 9206099.5

[51] Int. Cl.[5] ..... F04B 23/12; F04C 15/00

[52] U.S. Cl. ..... 417/206; 418/77; 418/188

[58] Field of Search ..... 417/205, 206; 418/3, 418/72, 77, 188

[56] References Cited

U.S. PATENT DOCUMENTS

| | | | |
|---|---|---|---|
| 2,641,238 | 6/1953 | Roosa | 417/206 |
| 3,228,339 | 1/1966 | Evans et al. | 417/206 |
| 3,343,494 | 9/1967 | Erikson et al. | 418/188 |
| 3,507,579 | 4/1970 | Kemp | 417/206 |
| 4,463,727 | 8/1984 | Babitzka et al. | 123/458 |
| 4,475,870 | 10/1984 | Eickmann | 417/206 |
| 4,486,154 | 12/1984 | Duplat et al. | 417/487 |
| 4,540,347 | 9/1985 | Child | 418/188 |

FOREIGN PATENT DOCUMENTS

| | | | |
|---|---|---|---|
| 0073968 | 3/1983 | European Pat. Off. . | |
| 0129020 | 12/1984 | European Pat. Off. . | |
| 0513998 | 11/1992 | European Pat. Off. . | |
| 2521229 | 8/1983 | France . | |
| 67810 | 6/1977 | Japan | 417/205 |
| 2103728 | 2/1983 | United Kingdom . | |
| 2116289 | 9/1983 | United Kingdom . | |

*Primary Examiner*—Richard A. Bertsch
*Assistant Examiner*—Roland G. McAndrews, Jr.
*Attorney, Agent, or Firm*—Trexler, Bushnell, Giangiorgi & Blackstone, Ltd.

[57] ABSTRACT

A fuel pumping apparatus for supplying fuel to an internal combustion engine has a drive shaft which is coupled to a rotary part of a high pressure pump. A low pressure pump for supplying fuel to the high pressure pump has a rotor mounted about the drive shaft, a stator and side plates on opposite sides of the stator. The stator has an internal surface engaged by vanes carried by the rotor and one end plate has an arcuate outlet port which is connected to a transfer port formed in the side plate but inwardly of the outlet port. The transfer port is connected by passage means in the rotor with a fuel supply passage in the drive shaft.

6 Claims, 1 Drawing Sheet

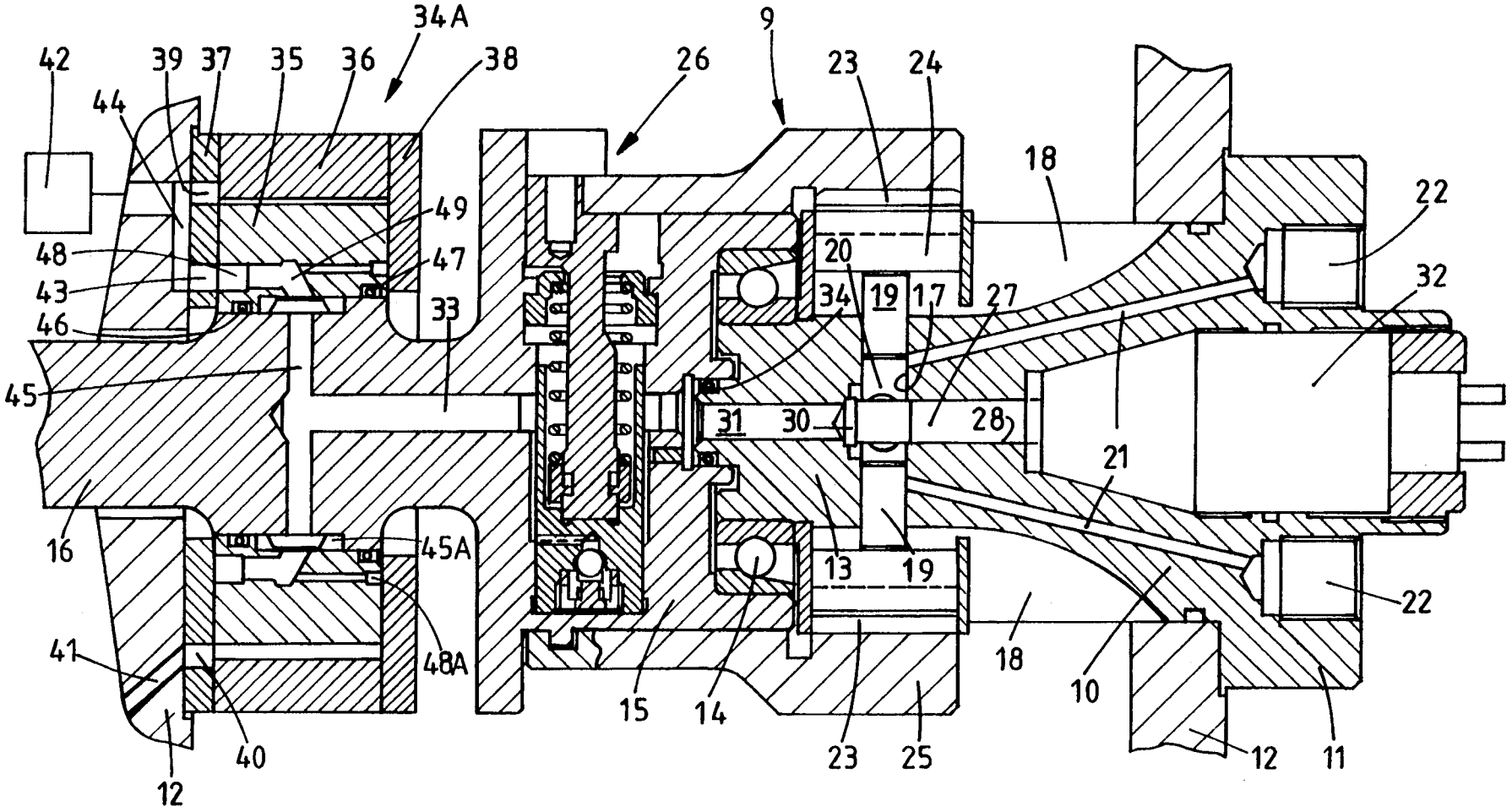
22
32
22
11
12
21
10
18
18
27
28
24
17
19
19
25
23
20
34
13
23
9
30
31
14
26
15
38
34A
49
47
33
45A
48A
36
35
40
37
39
12
44
42
48
43
46
45
16
41

TWO STAGE FUEL PUMP WITH PRESSURE PASSAGE IN THE FIRST STAGE ROTOR

BACKGROUND OF THE INVENTION

This invention relates to a fuel pumping apparatus for supplying fuel to an internal combustion engine, the apparatus comprising a housing, a drive shaft extending from the housing for connection in use to a rotary part of the associated engine, a high pressure fuel pump mounted within the housing and having a rotary part which is coupled to the drive shaft and a low pressure pump for supplying fuel to the high pressure pump.

OBJECTS AND SUMMARY OF THE INVENTION

The object of the invention is to provide an apparatus of the kind specified in a simple and convenient form.

According to the invention in an apparatus of the kind specified the low pressure pump comprises a vane type pump having a rotor which is non-rotatably located about the drive shaft and carries vanes, a stator ring defining an internal surface for engagement by the vanes, the low pressure pump further including a pair of end plates mounted at the opposite ends respectively of the stator ring, a segmental outlet port formed in one of said plates said outlet port communicating with a space defined between the rotor and said surface of the stator ring, a transfer port formed in said one plate inwardly of said outlet port, passage means connecting said ports, a supply passage in the drive shaft through which fuel can flow to the high pressure pump and further passage means in the rotor which is in constant communication with said transfer port and said supply passage.

BRIEF DESCRIPTION OF THE DRAWING

An example of a pumping apparatus in accordance with the invention will now be described with reference to the accompanying drawing which is a sectional side elevation.

DESCRIPTION OF THE PREFERRED EMBODIMENT(S)

Referring to the drawing the apparatus comprises a body 10 having a flange 11 which locates against a portion of the housing 12 of the apparatus. The body 10 defines a spigot portion 13 at its end remote from the flange and the spigot portion is surrounded by a bearing 14 which locates an enlarged portion 15 of a drive shaft 16 which extends from the housing 12 and which in use, is coupled to a rotary part of the associated engine so that it is driven in timed relationship therewith. Formed in the body 10 is in the particular example a pair of transversely extending bores 17 the axes of which are disposed at right angles to each other and nominal to the axis of rotation of the drive shaft. The outer ends of the bores 17 open into slots 18 formed in the body 10. Each bore accommodates a pair of pumping plungers 19. The inner ends of the plungers together with the bores form a pump working chamber 20 of a high pressure fuel pump 9.

Communicating with the bores at positions on opposite sides of the point of intersection thereof are outlet passages 21 which communicate with outlets 22 arranged in use to be connected to the injection nozzles respectively of the associated engine.

Located in the slots 18 are cam followers each of which comprises a roller 23 which is carried in a shaped recess formed in a shoe 24. The shoes engage the outer ends of the plungers 19 respectively and the rollers engage the internal peripheral surface of an annular cam ring 25 which is mounted about the enlarged portion 15 of the drive shaft and is coupled thereto so as to rotate therewith by a mechanism generally indicated at 26, which enables the cam ring to be adjusted angularly relative to the drive shaft. A more complete description of the mechanism 26 is to be found in the specification of our co-pending British application 9204417.1.

On the internal peripheral surface of the cam ring there is formed a plurality of cam lobes one less in number than the number of plungers 19. The angular spacing of the cam lobes is equal and is as if there were four lobes. In place of the missing cam lobe there is formed a recess and the depth of the recess is such that when a roller is engaged therein, the associated plunger 19 moves outwardly to a position to expose the entrance into the bore 17 of the associated outlet passage 21. The drawing shows the upper plunger in the outermost position with the upper passage 21 communicating with the pump working chamber 20. The plungers 19 and the cam lobes on the cam ring define the high pressure fuel pump 9.

In order to control the quantity of fuel which is supplied to the associated engine each time the plungers are moved inwardly, a spill valve is provided which includes an axially movable valve member 27. The valve member is located within a passage 28 extending within the body and the valve member extends through the pump working chamber and defines a head 30 which can be urged into engagement with a seating defined about an extension 31 of the passage 28. The valve head is movable into engagement with the seating by means of an electromagnetic actuator 32 the operation of which is controlled by an electronic control system. With the valve head in engagement with the seating during inward movement of the plungers 19 under the action of the cam lobes, fuel will be displaced from the pump working chamber along the connected outlet passage 21 to the associated engine. This flow of fuel takes place only so long as the valve head is in engagement with the seating so that flow of fuel to the associated engine can be halted by de-energizing the actuator. When the valve head is lifted from the seating the surplus fuel flows along the passage 31 and this passage also serves to convey fuel to the pump working chamber during outward movement of the plungers.

The drive shaft is provided with a supply passage 33 which is in communication with the passage 31 by reason of the fact that a portion of the drive shaft surrounds a projecting portion of the body through which the passage 31 extends. A seal 34 is provided to minimize escape of fuel.

The supply of fuel to the working chamber 20 is effected by means of a low pressure pump which is generally indicated at 34A. The low pressure pump is a vane pump and comprises a rotor 35 mounted about the shaft 16 and a stator ring 36 which is located between a pair of end plates 37, 38. The end plate 37 is located against a wall of the housing 12 and the internal peripheral surface of the stator ring 36 is eccentric relative to the axis of rotation of the drive shaft. In the end plate 37 there is formed an arcuate outlet port 39 and an arcuate inlet port 40 the latter being connected to a fuel inlet passage 41 in the housing. The output pressure of the pump is controlled by a relief valve 42 and in order to convey fuel from the outlet port 39 there is formed inwardly of the port and in the end plate 37, a transfer port 43. The transfer port 43 is in communication with the outlet port 39 by way of a groove 44 formed in the adjacent portion of the housing.

The passage 33 communicates with two radially disposed passages 45 which break out on to the periphery of the drive shaft at a position between spaced annular sealing elements 46, 47 which are interposed between the inner peripheral surface of the rotor 35 and the drive shaft. Moreover, formed in the rotor is passage means in the form of a circumferential groove 48 which is in constant communication with the port 43 and a passage 49 which connects with the groove 48 at one end and at its other end, opens on to the internal surface of the rotor at a position intermediate the sealing members 46, 47. In operation fuel which is pumped through the outlet port 39 is supplied to the passage 33 and transferred to the passage 31 so that the pump working chamber 20 can be filled with fuel when the valve 27 is lifted from its seating and when the plungers 19 are allowed to move outwardly.

For convenience of assembly the drive shaft 16 is of stepped form within the rotor 35 and the internal surface of the rotor is provided with a rib for engagement about the drive shaft the actual connection between the drive shaft and the rotor being a spline connection as indicated. Since there is no relative rotation between the rotor and the drive shaft the sealing members 46, 47 can be simple elastomeric sealing members however, it is thought that providing the clearances between the drive shaft and the rotor are carefully controlled, there may be no need for sealing members.

The fuel pressure within the annular space 45A which accommodates the spline connection between the rotor and the drive shaft, imposes an axial thrust on the drive shaft which can be used to balance the axial thrust in the opposite direction due to the fuel pressure within the passage 33 and that portion of the drive shaft adjacent the body 10 which is exposed to the fuel pressure. It also generates an axial thrust on the rotor 35 tending to urge it towards the side plate 37. However, the fuel pressure within the circumferential groove 48 generates a larger axial thrust on the rotor acting in the opposite direction. By the provision of a groove 48A in the opposite end face of the rotor as illustrated, and by connecting the groove 48A to the passage 49, pressure balance of the rotor can be restored.

The mechanism 26 which effects relative rotation between the cam ring 25 and the drive shaft, incorporates a fluid pressure operable piston and the pressure applied to this piston is supplied from the passage 33 by way of an enlarged portion of the bore in which the piston is located and through a passage formed in the piston.

I claim:

1. A fuel pumping apparatus for supplying fuel to an internal combustion engine comprising a housing, a drive shaft extending from the housing for connection in use to a rotary part of an associated engine, a high pressure fuel pump mounted within the housing and having a rotary part which is coupled to the drive shaft and a low pressure fuel supply pump for supplying fuel to the high pressure fuel pump, said low pressure pump comprising a vane type pump having a rotor which is non rotatably located about the drive shaft, the rotor carrying vanes for engagement with an internal surface of a stator ring, a pair of end plates mounted at opposite ends of the stator ring, an arcuate outlet port formed in one of said pair of end plates, a transfer port formed in the same one of said pair of end plates inwardly, with respect to the drive shaft, of said outlet port, passage means connecting said ports, a supply passage in the drive shaft through which fuel can flow to the high pressure pump, and further passage means in the rotor which is in constant communication with said supply passage and said transfer port.

2. A fuel pumping apparatus according to claim 1, in which said further passage means includes a circumferential groove formed in a first face of the rotor, and a passage which connects said groove with an annular space defined between the rotor and the drive shaft, said supply passage communicating with said space.

3. A fuel pumping apparatus according to claim 2, in which said annular space has opposite end walls defined on the dive shaft and rotor respectively, the fuel pressure in said space which is applied to the end wall defined by the drive shaft acting to impart an axial thrust to the drive shaft, and the fuel pressure in said space which is applied to the end wall defined by the rotor acting to impart an axial thrust to the rotor in opposition to an axial thrust developed on the rotor by the fuel pressure in the circumferential groove.

4. A fuel pumping apparatus according to claim 2 or claim 3, including a further circumferential groove formed in a second face of the rotor opposite to said first mentioned circumferential groove, said grooves being in communication with each other.

5. A fuel pumping apparatus according to claim 4, including a spline connection serving to connect the rotor to the drive shaft.

6. A fuel pumping apparatus according to claim 5, including seal means interposed between the rotor and the drive shaft, said seal means being located on opposite sides of said annular space respectively.

* * * * *